US007529512B2

(12) United States Patent
Adams et al.

(10) Patent No.: US 7,529,512 B2
(45) Date of Patent: May 5, 2009

(54) FAST DECAY ULTRASONIC DRIVER

(75) Inventors: Jerry F. Adams, Waterport, NY (US); David B. Montfort, Webster, NY (US); John R. Falvo, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 365 days.

(21) Appl. No.: 11/592,362

(22) Filed: Nov. 3, 2006

(65) Prior Publication Data

US 2008/0107458 A1 May 8, 2008

(51) Int. Cl.
*G03G 15/16* (2006.01)

(52) U.S. Cl. ..... 399/319

(58) Field of Classification Search ..... 399/319, 399/297; 310/312, 320, 321, 322, 323.19
See application file for complete search history.

(56) References Cited

U.S. PATENT DOCUMENTS 4,987,456 A * 1/1991 Snelling et al. ..... 399/319
5,005,054 A * 4/1991 Stokes et al. ..... 399/319
5,010,369 A * 4/1991 Nowak et al. ..... 399/319
5,016,055 A * 5/1991 Pietrowski et al. ..... 399/319
5,025,291 A * 6/1991 Nowak et al. ..... 399/319
5,210,577 A * 5/1993 Nowak
5,282,005 A * 1/1994 Nowak et al. ..... 399/319
5,282,006 A * 1/1994 Fletcher
5,477,315 A 12/1995 Mashtare
5,512,989 A * 4/1996 Montfort
5,512,990 A * 4/1996 Friel et al.
5,512,991 A * 4/1996 Montfort
6,157,804 A 12/2000 Richmond et al.
6,205,315 B1 3/2001 Montfort et al.
6,507,725 B1 1/2003 Adams et al.
6,579,405 B1 6/2003 Montfort
2006/0216631 A1* 9/2006 Yamazaki et al.
2006/0257158 A1* 11/2006 Calamita
2007/0104519 A1* 5/2007 Soures et al.
2007/0183821 A1* 8/2007 Parks ..... 399/319

OTHER PUBLICATIONS

European Search Report, EP Application No. EP07118510, Dated Feb. 1, 2008, Munich, Germany.

* cited by examiner

*Primary Examiner*—Susan S Lee
(74) *Attorney, Agent, or Firm*—Fay Sharpe LLP

(57) ABSTRACT

Acoustic Transfer Assist (ATA) systems are used in media printing devices to help transfer toner to paper by use of ultrasonic vibrations. The transducer is driven at its resonant frequency, though somewhat dampened. To shorten the decay time of the transducer when its vibration is not desired, a compensating signal is used. A reverse drive voltage is used during transducer shut-off. The reverse drive causes the transducer to vibrate at its normal resonant frequency, but at a 180° phase shift, causing the transducer to stop vibrating significantly faster than without a reverse drive. An open phase-locked loop system drives the transducer from resonance to rest. When the transducer stops vibrating, current to the reverse drive loop is cut off.

20 Claims, 4 Drawing Sheets

FAST DECAY ULTRASONIC DRIVER

CROSS REFERENCE TO RELATED PATENTS AND APPLICATIONS

This application is an improvement of a device that employs an acoustic transfer system, such as the one described in U.S. Pat. No. 6,157,804 to Richmond, et al.

BACKGROUND

Acoustic Transfer Assist (ATA) devices are used to help transfer toner to paper through the use of ultrasonic vibrations. ATA is especially valuable when transferring toner to rough, embossed, or otherwise uneven papers. A piezoelectric transducer is driven at its resonant frequency, with appropriate damping. The transducer is a very high Q resonant electrical circuit driven at its resonant frequency. The factor "Q" is a measure of the rate at which a vibrating system dissipates its energy into heat. A higher Q indicates a lower rate of heat dissipation. The vibration in the transducer is electrically analogous to current in the resonant circuit, and like any very high Q circuit, the current rises and decays relatively slowly in reaction to application or removal of a drive signal.

At certain points in the printing process, it is desirable for the transducer to cease the vibrations to avoid print quality defects. For example, if the transducer is vibrating in certain areas, toner can be undesirably transferred to mechanical elements of the printer and then transferred to other images, resulting in errors in those images. Typically, to turn the transducer off, a drive signal is simply cut off from the transducer. This method of turn off is relatively slow. The transducer continues to vibrate for approximately 5 ms after the drive signal is cut off. This type of decay is typical with any oscillating mechanical system. The existing delay between signal shut-off and transducer inactivity can produce defects in current ATA systems. Because of this delay, the space between sheets of media needs to be extended so toner is not accidentally applied to areas where it should not be, ultimately effecting how many sheets of print media can be processed in any given time period. The time it takes for the transducer to decay ultimately effects the operating speed of the printer. For high speed ATA enabled machines, this decay time can represent a significant delay in job processing times.

INCORPORATION BY REFERENCE

U.S. Pat. No. 6,157,804 is hereby incorporated by reference in its entirety.

U.S. Pat. No. 6,205,315 is hereby incorporated by reference in its entirety.

U.S. Pat. No. 6,507,725 is hereby incorporated by reference in its entirety.

U.S. Pat. No. 6,579,405 is hereby incorporated by reference in its entirety.

BRIEF DESCRIPTION

In accordance with one aspect, a media output device is disclosed. The device includes a drive belt configured to propagate printable media along a print path, and a piezoelectric transducer for emitting ultrasonic vibrations that assist in adhering toner to the printable media. A transducer drive control circuit provides a drive signal to the transducer. The transducer drive control circuit includes an inverted drive portion that selectively inverts the drive signal to dampen vibrations of the transducer.

DETAILED DESCRIPTION

Figure 1:
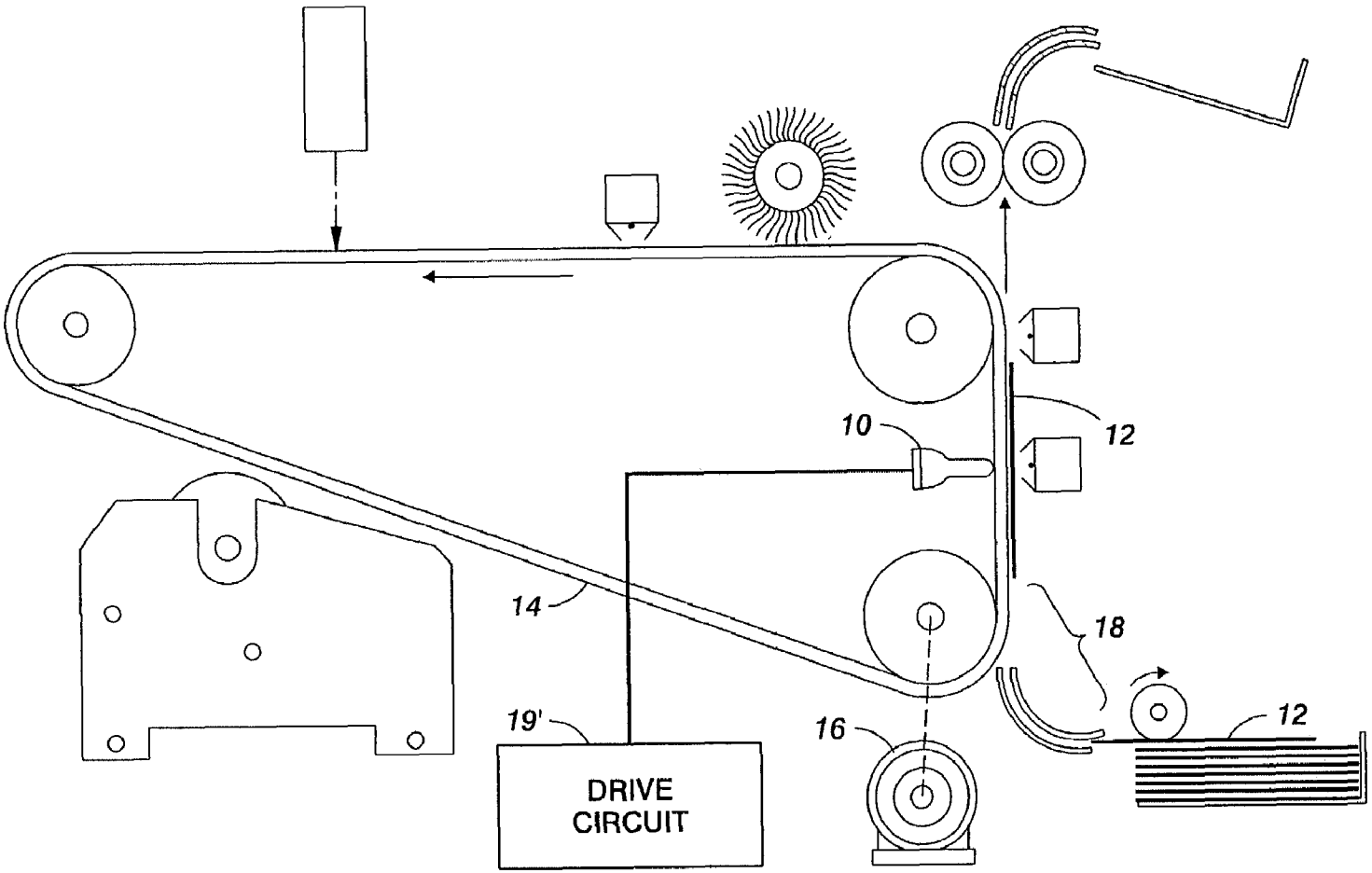
FIG. 1 is a profile view of a media output device that employs an ATA system.

With reference to FIG. 1, a typical xerographic device that employs an ATA system is depicted. A drive circuit 19' causes a transducer 10 to vibrate at its normal resonant frequency, both with and without a 180° phase shift. This approach is effectively an open loop system based on a well behaved second order under damped system. The transducer 10 is used to assist in adhering toner to print media 12 as sheets of media pass by the transducer 10. The transducer 10 produces ultrasonic vibrations in a direction perpendicular to a drive belt 14. The vibrations of the transducer 10 are preferably about 62 kHz, but can be as much as 63.2 kHz, or more, or as low as 61 kHz, or less. This range of frequencies represents a typical range of resonant frequencies for transducers used in ATA devices, but it is to be understood that other frequency ranges are appropriate when using transducers with different resonant frequencies. A motorized drum 16 rotates the drive belt 14 that moves the print media by the transducer 10. Control circuitry 19' drives the transducer 10 and is described in more detail hereinbelow. Between each sheet of print media 12 is a patch of empty space in which a process control patch is developed after some delay following the training edge of the last prior sheet. 18. The length of delay from the sheet trail edge to the process control patch 18 is dictated in part by a decay time of the transducer 10 after it has been activated. The longer it takes for the transducer 10 to become inactive, the longer the delay until the process control patch 18 has to be, so toner is not errantly applied to subsequent sheets of print media 12.

Figure 2:
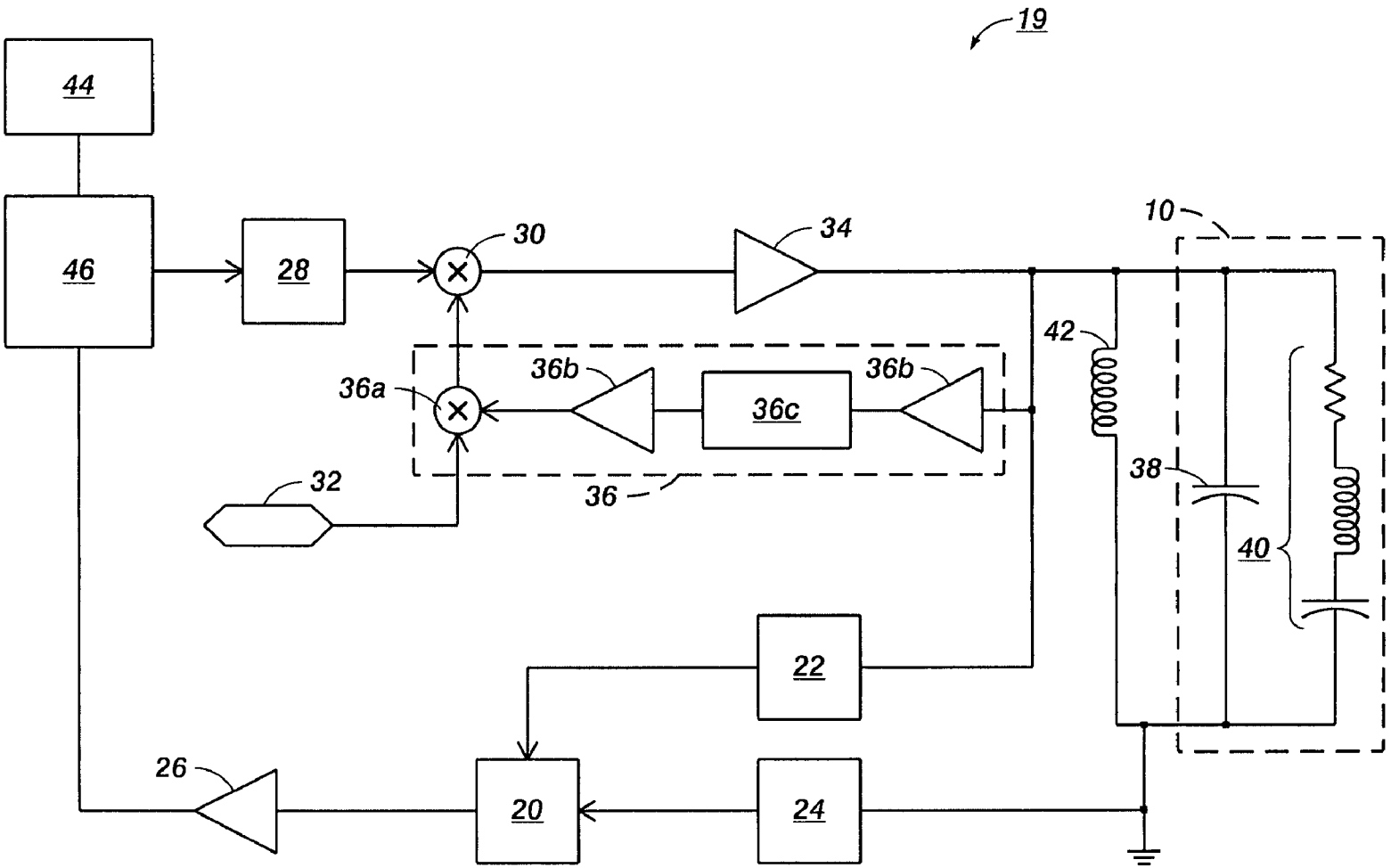
FIG. 2 is a circuit representation of a typical ATA drive circuit.

With reference to FIG. 2, a circuit diagram portraying normal operation of a piezoelectric transducer driving circuit 19 is shown. A voltage phase detector 20 receives a voltage signal and a current signal and determines the phase between them. The voltage signal comes from a voltage comparator 22, and the current signal comes from a current comparator 24. The comparators 22, 24 are amplitude comparators whose outputs are digital signals with value of "1" when the input signal (current for comparator 24 and voltage for comparator 22) is greater than zero and "0" when the input signal is less than zero. Comparators 22 and 24 thus digitize the voltage into, and the current drawn by transducer 10, respectively. The output from the phase detector 20 is a pulse-width modulated signal whose PWM duty cycle is proportional to the phase difference of the two inputs. In order to use the pulse-width modulated signal, it is first converted into an analog signal. A filter 26 takes the pulse-width modulated signal and outputs a phase dependent signal whose voltage is proportional to the detected phase.

From the filter 26, the phase dependent signal is fed through a switch 46 into a voltage controlled oscillator 28. The switch 46 is discussed in greater detail below. The frequency of the output of the voltage controlled oscillator 28 is dictated by the input voltage of the phase dependant signal. That is, the greater the input voltage, the higher the output frequency. So ultimately, the frequency of the signal output from the oscillator 28 is dependent on the phase detected by the phase detector 20.

The signal from the oscillator 28 is then passed through a multiplication block 30. The multiplication block 30 provides amplitude control for the driving signal output from the oscillator 28. The desired, or control voltage 32 at which the transducer 10 will be driven is known, and the multiplication block 30, working in conjunction with a power amplifier 34 either increases or decreases the voltage of the driving signal depending on how it compares to the desired driving (control) voltage 32. The output signal from the amplifier 34 is applied via a standard buffering, filtering and rectifying feedback loop 36 to the multiplication block 30. The feedback loop 36 includes its own multiplier 36*a* amplifiers 36*b* and a rectifier 36*c*. In addition to being fed back to the multiplication block 30, the drive signal from the amplifier 34 is also output to the transducer 10 to drive the vibrations of the transducer 10.

The preferred transducer 10 includes a shunt capacitor 38 and a series resonant circuit 40 in parallel with the shunt capacitor 38. It is to be understood that one skilled in the art will be aware of alternate working designs of the transducer 10. The shunt capacitor 38 is tuned by a tuning inductor 42 in parallel with the shunt capacitor 38.

A sweep generator 44 gradually sweeps the voltage of the input signal to find a point at which current becomes measurable. When current is detectable, the phase is close to the desired phase, and the switching circuitry 46 switches the input from the sweep generator 44 and hands control of the circuit over to the phase detector 20. In other words, the sweep generator 44 narrows all possible frequencies to a narrow band of frequencies in which the resonant frequency of the transducer 10 is located. The circuit is then driven at the resonant frequency of the transducer 10 when toner is being applied to the print media 12, and current does not flow through the circuit during times where no print media is present, such as between sheets, that is, over a process control patch 18. In the above described situation, where the transducer 10 is allowed to naturally decay, the transducer 10 requires approximately 5 ms after the driving signal is shut off to become sufficiently inactive to the point where it will not help affix toner to a media surface. An inverted drive circuit reduces the time it takes for the transducer 10 to be dampened down to an inactive level.

Figure 3:
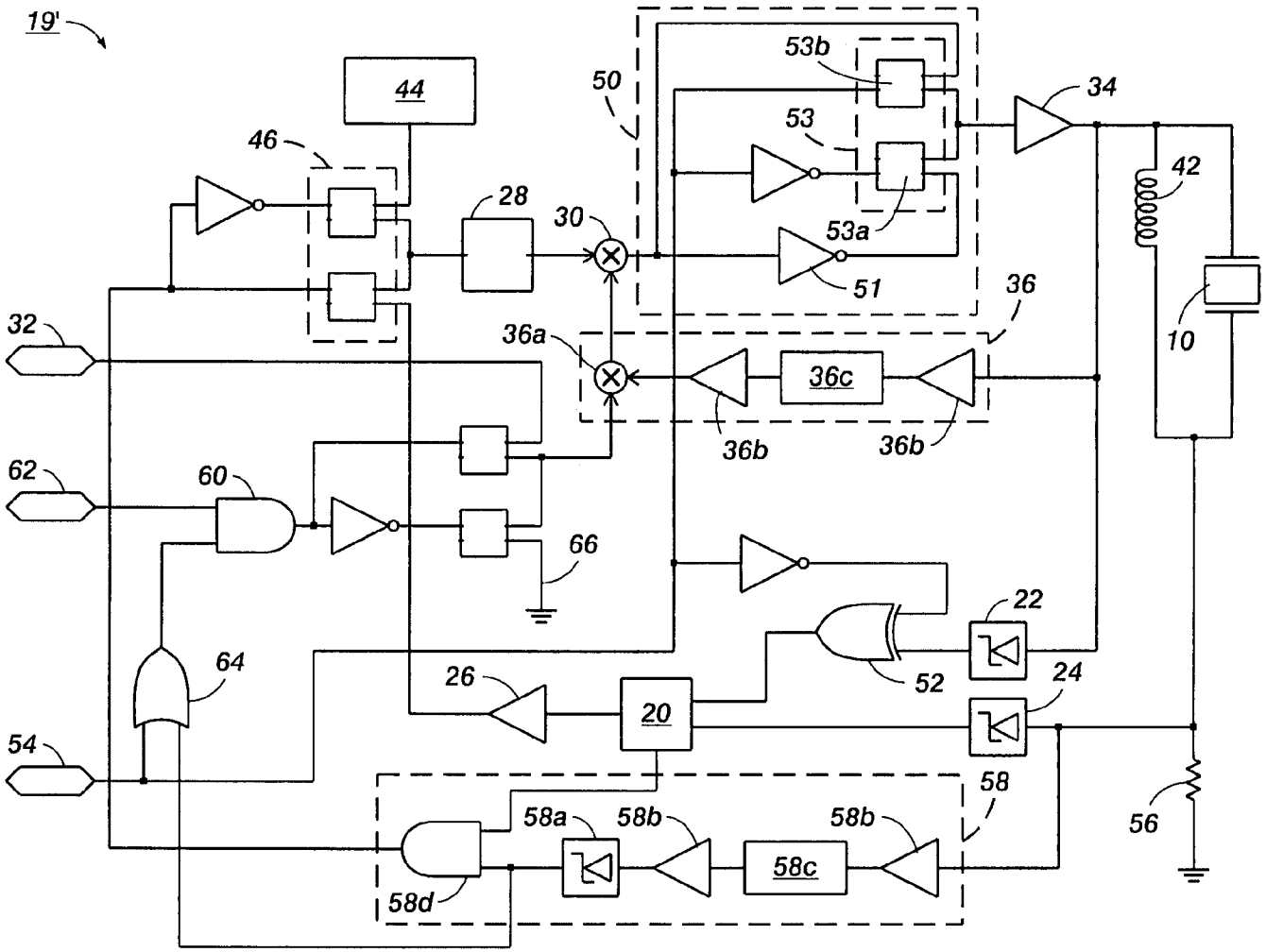
FIG. 3 shows a circuit representation of an ATA drive circuit that includes reverse resonance drive elements.

Referring now to FIG. 3, an exemplary embodiment of a circuit 19' showing an inverted drive circuit 50 is depicted. The circuit 19', as depicted in FIG. 3, builds off of the circuit in FIG. 2 by adding the inverted drive circuit 50 and supporting circuit elements that allow the inverted drive circuit to function. Generally, in periods where it is desirable to inactivate the transducer 10, the inverted drive circuit 50 provides a signal that is 180° out of phase with the steady state driving signal. This dampens the transducer significantly faster than simply allowing it to decay naturally. The inverted drive circuit 50 includes an inverting amplifier 51, and a drive switch 53. The drive switch 53 includes an inversion side 53*a*, and a steady state side 53*b*. In accordance with concepts of the present application, a blanking signal 54 is applied to initiate the reverse drive of the inverted drive circuit 50.

When the blanking signal 54 is applied to the circuit 19', it activates the inversion side 53*a* of the drive switch 53, which allows current to flow through the inverting amplifier 51. The inverting amplifier 51 produces the drive signal that is 180° out of phase with the steady state operating signal. This inverted drive signal is applied to the transducer 10, effecting a rapid decay of the transducer's oscillations. Once the transducer 10 has stopped oscillating, the inverted drive current is cut off. When the blanking signal 54 is not present, the steady state side 53*b* of the drive switch 53 is active, and current can flow normally to the power amplifier 34 and on to the transducer 10.

With the addition of an exclusive OR (XOR) gate 52 between the voltage comparator 22 and the phase detector 20, the circuit 19' can be tricked into detecting a normal operating signal when the signal is actually 180° out of phase. One of the inputs of the XOR gate 52 is attached to the output of the voltage comparator 22. The other input of the XOR gate 52 is attached to the blanking signal 54. The input from the voltage comparator 22 is "on" when the circuit 19' is operating. That is, there is a signal coming from the transducer drive portion of the circuit 19', whether it is inverted or not. When the blanking signal 54 is applied, it activates the second input on the XOR gate 52, which inverts the XOR gate's 52 output. Resultantly, the signal originating in the inverted drive circuit 50 voltage phase comparator 22 and ending at the output of the XOR gate 52 is doubly inverted, and the phase comparator 20 is fooled into thinking that drive signal is in phase the whole time. Beneficially, the circuit 19' will continue to operate when a signal that is 180° out of phase with the resonant signal is applied to the transducer 10. The 180° out of phase signal is triggered when the blanking signal 54 is introduced as an additional input signal.

If the inverted drive signal is allowed to persist, the transducer current (and thus vibration) will continue to go toward and then beyond zero. Since the object of this invention is to facilitate rapid decay to zero only of the transducer current the inverted signal must be cut-off from the transducer as it approaches the zero current state. When no measurable current is passing through the transducer 10 anymore, as measured across resistor 56, circuit chain 58 detects the zero current and switches off the inverted current to the transducer 10, resetting the circuit 19' to normal operation. The circuit chain 58 includes a Zener diode 58*a*, amplifiers 58*b*, a rectifier 58*c*, and an AND gate 58*d*. The signal from the transducer 10 is fed into the circuit chain 58 and into the AND gate 58*d*. The other input of the AND gate comes from the phase detector 20. The signal from the circuit chain 58 is then fed into the switch 46. With the addition of the inverted drive circuit 50 and supporting elements, the time of transducer 10 decay is reduced from approximately 5 ms to approximately 1 ms.

There are times when the drive circuit 19' delivers no current to the transducer 10. This is desirable, for example, when the output device is not in operation. More pertinent, however, the circuit 19' does not supply the transducer 10 with any current in periods where there is no print media 12 present, for example, between sheets of media 12, in a process control patch, or if the media sheet is currently being inverted in a duplex path, etc. Overall circuit 19' operation is controlled by an AND gate 60. The AND gate 60 must receive a signal at both of its inputs to activate the circuit 19'. One input of the AND gate 60 is attached to an enabling signal 62. This enabling signal 62 is applied when a job commences, and is removed when the job is finished. In other words, the circuit 19' is only active when a print job is proceeding, for instance, after a copy job has been programmed, and a user hits a start button. Regardless of the reason behind the enabling signal 62, it is externally applied.

The AND gate 60 needs another signal, however, before it will activate the circuit 19'. The second signal comes from within the circuit 19', that is, from an OR gate 64. The OR gate 64 is active, and will provide the necessary signal to activate the AND gate 60 either when the blanking signal 54 is not asserted (indicating that normal operation of the circuit 19' is desired) or when the circuit chain 58 is supplying a signal, indicating that there is measurable transducer 10 current. When there is measurable transducer 10 current, it is the case when the reverse drive is desired, that is, while the transducer 10 vibration is dying. If either of the blanking signal 54 or a signal from the circuit chain 58 is present, and the enabling signal 62 is present, the circuit will be in operation. Failing either or both of those conditions, the signal is run to ground 66, and the circuit 19' will not operate.

Figure 4:
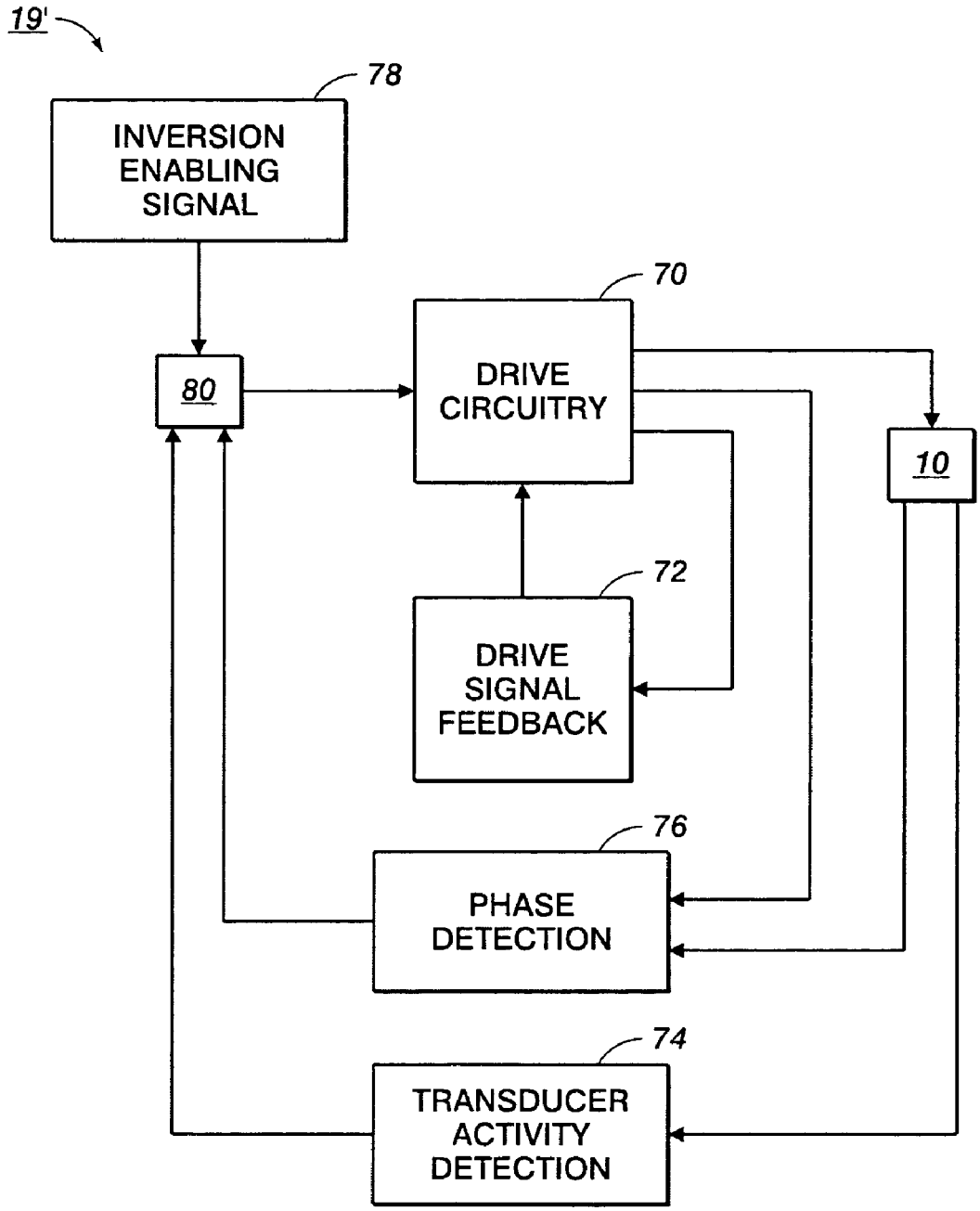
FIG. 4 is a black box diagram of the circuit of FIG. 3.

With reference now to FIG. 4, an overview of the circuit 19' is provided. In the previous figures, an exemplary implementation has been described, but it is to be understood that the circuit 19' can be described more generally. The circuit 19' includes drive circuitry 70 that is capable of generating a transducer drive signal and an inverted drive signal. As previously discussed, the inverted drive signal is for producing vibrations in the transducer 10 at its resonant frequency that are 180° out of phase to actively dampen vibrations of the transducer 10.

Generally, in order to enable the drive circuitry 70 to function as desired, the circuit 19' has a double feedback loop architecture. The first feedback loop is a drive signal feedback loop 72 that involves feedback from the drive signal before it gets to the transducer 10. The drive signal feedback loop 72 acts as quality control for the signals output by the drive circuitry 70, ensuring that they stay within desired ranges. The second feedback loop includes a transducer activity detection feedback loop 74. The transducer activity detection feedback loop 74, working in concert with phase detection circuitry 76 and an inversion enabling signal 78 introduced from outside the circuit 19', enables switching of the drive circuitry 70 from the drive signal to the inverted drive signal and back again. Switching circuitry 80 is used to process the inversion enabling signal 78 and the signals from the phase detection circuitry 76 and the transducer activity detection circuitry 74 to activate and deactivate the drive circuitry 70 as desired.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A media output device comprising:

a drive belt configured to propagate printable media along a print path;

a transducer for emitting ultrasonic vibrations that assists in adhering toner to the printable media;

a transducer drive control circuit that provides a drive signal to the transducer, the transducer drive control circuit including an inverted drive portion that selectively inverts the drive signal to dampen vibrations of the transducer.

2. The media output device as set forth in claim 1, further including:

a control reference that holds the drive signal to the transducer substantially close to its resonance frequency.

3. The media output device as set forth in claim 1, wherein the transducer drive control circuit further includes:

a blanking input for initiating operation of the inverted drive portion.

4. The media output device as set forth in claim 3, wherein the transducer drive control circuit further includes:

an exclusive OR gate that re-inverts the inverted drive signal when the inverted drive portion is in operation.

5. The media output device as set forth in claim 4, wherein the exclusive OR gate re-inverts the inverted drive signal in response to sensing the blanking input.

6. The media output device as set forth in claim 1, wherein the transducer drive control circuit further includes:

an inverted signal shut-off circuit chain that resets the transducer drive control circuit when the transducer substantially stops vibrating.

7. The media output device as set forth in claim 1, wherein the transducer includes:

a shunt capacitor; and, a series resonant circuit in parallel with the shunt capacitor.

8. The media output device as set forth in claim 7, wherein the transducer drive control circuit further includes:

a tuning inductor that tunes the shunt capacitor.

9. The media output device as set forth in claim 1, wherein the transducer oscillates at a frequency less than or equal to 63.2 kHz, and more than or equal to 61 kHz.

10. The media output device as set forth in claim 9, wherein the transducer oscillates at a frequency of 62 kHz.

11. A method of adhering toner to a printable medium comprising:

feeding the medium through a print path of an output device;

passing the medium past an ultrasonic transducer;

providing the transducer with a drive current, thereby causing the transducer to oscillate; and providing the transducer with an inverted drive current, thereby causing the transducer to reduce oscillations.

12. The method as set forth in claim 11, further including:

stopping the oscillations of the transducer with the inverted drive current.

13. The method as set forth in claim 12, further including:

cutting off the inverted drive current when the transducer has substantially stopped oscillating.

14. The method as set forth in claim 13, wherein the step of cutting off the inverted drive current occurs when a current that is substantially zero is measured across the transducer.

15. The method as set forth in claim 11, further including:

re-inverting the inverted drive current with an exclusive OR gate so that the drive current appears non-inverted to a phase detector.

16. The method as set forth in claim 11, further including:

providing a blanking input that causes the provision of the inverted drive current.

17. The method as set forth in claim 11 wherein the steps of providing include providing a drive signal that is at least 61 kHz, and no more than 63.2 kHz.

18. The method as set forth in claim 11, wherein the step of providing an inverted drive current includes providing a current that is 180° out of phase with the drive current.

19. The method as set forth in claim 18, wherein the drive current and the inverted drive current are substantially the same frequency.

20. A xerographic device including:

at least one feed path for propagating printable media through the xerographic device;

a transducer for assisting in a toner adhesion process, wherein the transducer emits ultrasonic vibrations at its resonant frequency;

a transducer driving circuit for providing a driving signal to the transducer, the transducer driving circuit including:

a phase detector that measures the phase between an output voltage to the transducer and a current output from the transducer;

a loop filter that outputs a voltage signal that is proportional to the phase detected by the phase detector;

a voltage controlled oscillator that outputs a signal with a frequency that is dependant on the output voltage of the loop filter;

a drive circuit portion that provides a drive signal to the transducer;

an inverted drive circuit portion that provides an inverted drive signal to the transducer that is 180° out of phase with, and of the same frequency as the drive signal;

an exclusive or gate that re-inverts the inverted drive signal so that the phase detector interprets the inverted drive signal as the drive signal;

a circuit chain that detects when the transducer stops oscillating and causes the inverted drive circuit portion to cease providing the inverted drive signal.

* * * * *